US005707003A

United States Patent [19]

Miyake

[11] Patent Number: 5,707,003

[45] Date of Patent: Jan. 13, 1998

[54] BOX FILE

[75] Inventor: Yuichiro Miyake, Osaka, Japan

[73] Assignee: Kokuyo Co., Ltd., Osaka, Japan

[21] Appl. No.: 765,428

[22] PCT Filed: Sep. 29, 1995

[86] PCT No.: PCT/JP95/01984

§ 371 Date: Dec. 31, 1996

§ 102(e) Date: Dec. 31, 1996

[87] PCT Pub. No.: WO96/36498

PCT Pub. Date: Nov. 21, 1996

[30] Foreign Application Priority Data

May 18, 1995 [JP] Japan ..... 7/145728

[51] Int. Cl.[6] ..... B65D 85/00

[52] U.S. Cl. ..... 229/101; 206/245; 220/8

[58] Field of Search ..... 229/101; 206/245, 206/745; 220/4.21, 8, 529; 248/129

[56] References Cited

U.S. PATENT DOCUMENTS

| | | | |
|---|---|---|---|
| 776,042 | 11/1904 | Acheson | 206/745 |
| 1,254,991 | 1/1918 | Darst | 206/425 |
| 2,556,568 | 6/1951 | Aikman | 229/101 |
| 2,683,953 | 7/1954 | Hopkins | 229/101 |
| 3,700,159 | 10/1972 | Beigel | 229/101 |
| 3,900,157 | 8/1975 | Roth | 229/101 |
| 4,759,443 | 7/1988 | Egly | 206/425 |
| 5,192,019 | 3/1993 | Meehan | 229/101 |

FOREIGN PATENT DOCUMENTS

| | | | |
|---|---|---|---|
| 356306-A1 | 2/1990 | European Pat. Off. | 220/8 |
| 53-85222 | 12/1976 | Japan . | |
| 62-113740 | 7/1987 | Japan . | |
| 63-6879 | 1/1988 | Japan . | |
| 63-45621 | 3/1988 | Japan . | |
| 1-178986 | 12/1989 | Japan . | |
| 3-58143 | 6/1991 | Japan . | |
| WO 9510422 | 4/1995 | WIPO . | |

OTHER PUBLICATIONS

Microfilm of the specification and drawings annexed to the written application of Japanese Utility Model Application No. 168565/1976, Jul. 1978.

Microfilm of the specification and drawings annexed to the written application of Japanese Utility Model Application No. 99977/1986, Jan. 1988.

*Primary Examiner*—Gary E. Elkins
*Attorney, Agent, or Firm*—Lowe, Price, LeBlanc & Becker

[57] ABSTRACT

Box file (10) composed with first and second box forming components (11, 12) capable of being coupled together. First box forming component (11) has bottom plates (16) and back walls (17) between a pair of side walls (14, 15) in a state that side walls (14), bottom walls (16) and back walls (17) are provided with cut-off portions (14B, 16A, 17A). Second box forming component (12) has bottom plates (21) and back walls (22) connected with the side walls (20) and partition walls (24) provided between bottom plates (21) and back walls (22). Partition walls (24) are designed to pass over cut-off portions (14B) and bottom plates (21) and back walls (22) of second box forming component (12) are received in cut-off portions (16A, 17A).

6 Claims, 7 Drawing Sheets

BOX FILE

TECHNICAL FIELD

This invention relates to a so-called box file and, more particularly, to a box file capable of optionally changing its inside width to receive objects therein.

BACKGROUND ART

A box file, which has a certain inside space to receive therein objects, has previously been used when required to file the documents in an office work. The known box file is generally defined by a bottom plate, a pair of side walls respectively connecting with both sides of the bottom plate, and a back wall connecting with these side walls and back wall in a state that it opens into the air at the top portion to have a certain hollow receiving area. These box files are made of hard paper or plastic material to protect the objects from damage effectively using the material hardness and to make good use of space in conformity with types of objects.

However, it should be noticed that the documents as objects to be contained or filed is always increased naturally as time goes on, so that the conventional one has a latent disadvantage not to correspond to an exceeded width because of much documents since it strictly defines the maximum width to receive between both side walls.

Accordingly, if required to file exceeded documents over the defined width for a single box file, it is naturally necessary to use another box file. When files documents as objects to be filed and required to be arranged consistently and relevantly, it can not be expected to be filed within one box file.

On the contrary, in the conventional box files, when the documents to be contained or filed is rather small in number, the lower portions of the documents tends to be waved or curved down to the bottom direction and, possibly the prior documents may be covered with other documents filed later to thereby be hidden.

The present invention is conceived reviewing the above and has an object to provide a box file capable of changing its width cooperating with the amount of objects to be filed to assure a variable and stable receiving state for several types of the objects.

SUMMARY OF THE INVENTION

In order to achieve the above mentioned object, the conceived box file in the present invention is of a box file which is characterized to have two or more box forming components in a relatively parallel state, each component being defined by at least one plate as a mount surface to make the box forming component stand straight and at least one side wall connecting with the plate, so that the respective plates of the box forming components are coupled evenly on one plane and a first box forming component and a second box forming component are provided such that an intervals between the side walls thereof are reciprocally closed or departed and the respective side walls are adapted not to move in surface directions mutually.

The above-mentioned object will be also attained by a box file having a first box forming component having a pair of side walls and at least one bottom plate and at least one back wall provided between the side walls in an opening state into the air at least at a top portion thereof; and a second box forming component having one side wall formed into a shape symmetrical to or a similar figure smaller than the side wall of the first box forming component and in a parallel state with reference to the side wall of the first box forming component and at least one bottom plate and at least one back wall provided between edges of the side walls, so that the bottom plates and back walls of the first and second box forming components are adapted to be coupled together and the first box forming component and the second box forming component are provided such that an intervals between the side walls thereof are reciprocally closed or departed and the respective side walls are adapted not to move in surface directions mutually.

Now, the first and second box forming components are provided such that the bottom plates and the back walls are respectively aligned on one plane.

Furthermore, the first box forming component is provided with at least one cut-off portion in the bottom plate and the back wall respectively and the second box forming component is designed such that the bottom plate and the back wall thereof are received within the cut-off portions. The cut-off portions are recommended to be disposed separately in the bottom plate and the back wall.

It should be recognized that there are provided at least one partition wall having a smaller area than that of the side wall of the second box forming component between the bottom plate and the back wall of the second box forming component, and one side wall of the first box forming component has a cut-off portion corresponding to the partition wall, so that the partition wall passes through the cut-off portion and is disposed between the side walls of the first box forming component.

The first box forming component and second box forming component generally put their mounting surfaces on the desk and the like to be stood straight. The side walls of the respective box forming components are relatively arranged in a parallel state and thereafter the mount surfaces of the box forming components are aligned on one plane to so that the first and second box forming components are coupled together. In this state, an interval between the side walls can be considered to be an allowable width to receive therein objects to be received such as documents. The second box forming component is formed such that the side wall thereof is allowed to close to or depart from the side wall of the first box forming component to expand the width to receive objects between side walls. As a result, the conceived single box file can increase its receiving capacity in conformity with an increase of objects to be received.

As the second box forming component is provided with the partition wall, the documents are clamped between the partition wall and one of the side wall of the first box forming component and therefore, if the number of documents as objects to be received is small in number, the documents can be kept straight reliably and the troublesome wave of the documents does not come out due to drop in the bottom direction.

BEST MODE FOR CARRYING OUT THE INVENTION

The most preferable embodiment of the present invention will now be described with reference to the drawings.

Figure 1:
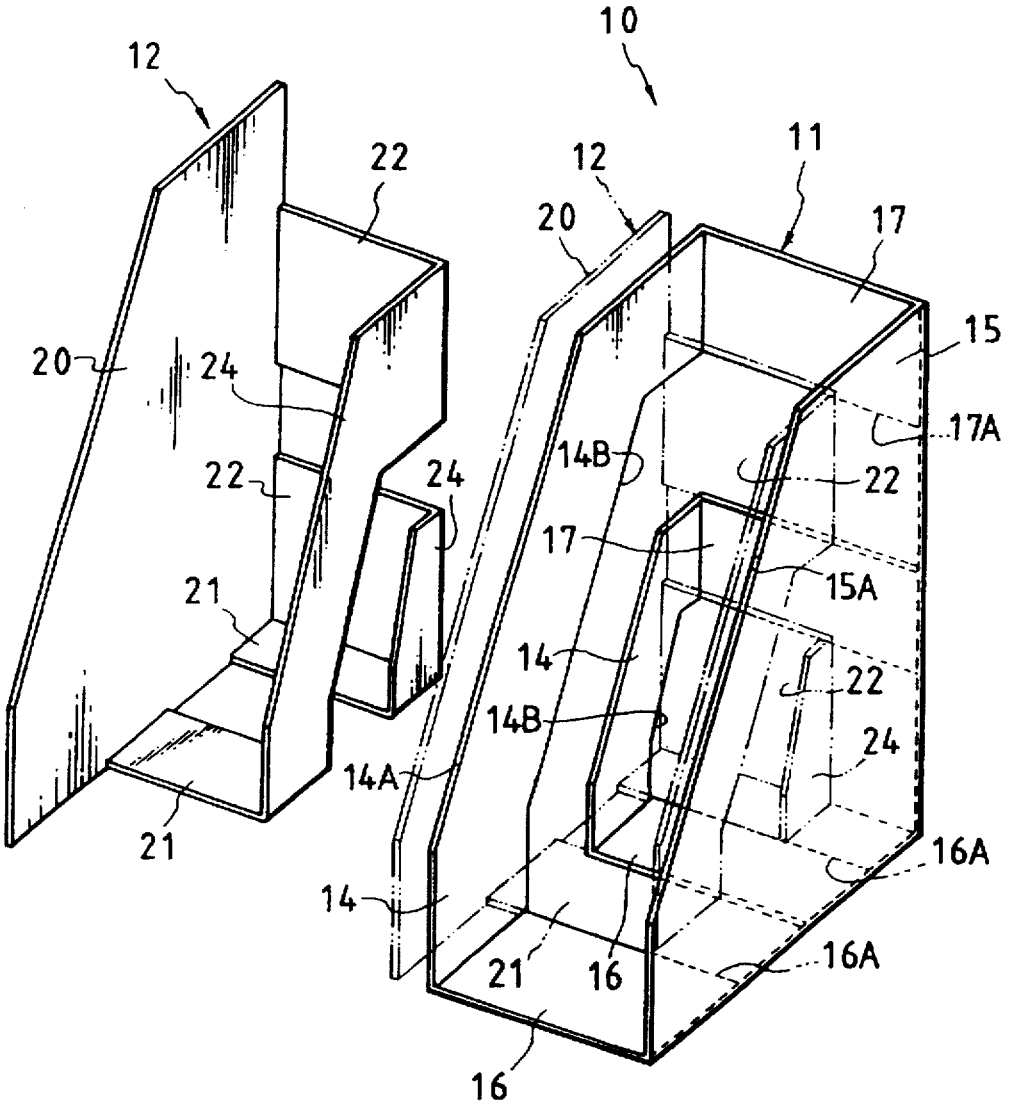
FIG. 1 is a perspective view of a first embodiment of the box file in accordance with the present invention.

FIG. 1 is a perspective view of the appearance of the overall composition of a box file in the first embodiment. As can be seen from the drawing, the box file 10 is essentially made up with a first box forming component 11 made of a suitable plastic material and a second box forming component 12 adapted to be integrally coupled with the first box forming component 11.

Figure 2:
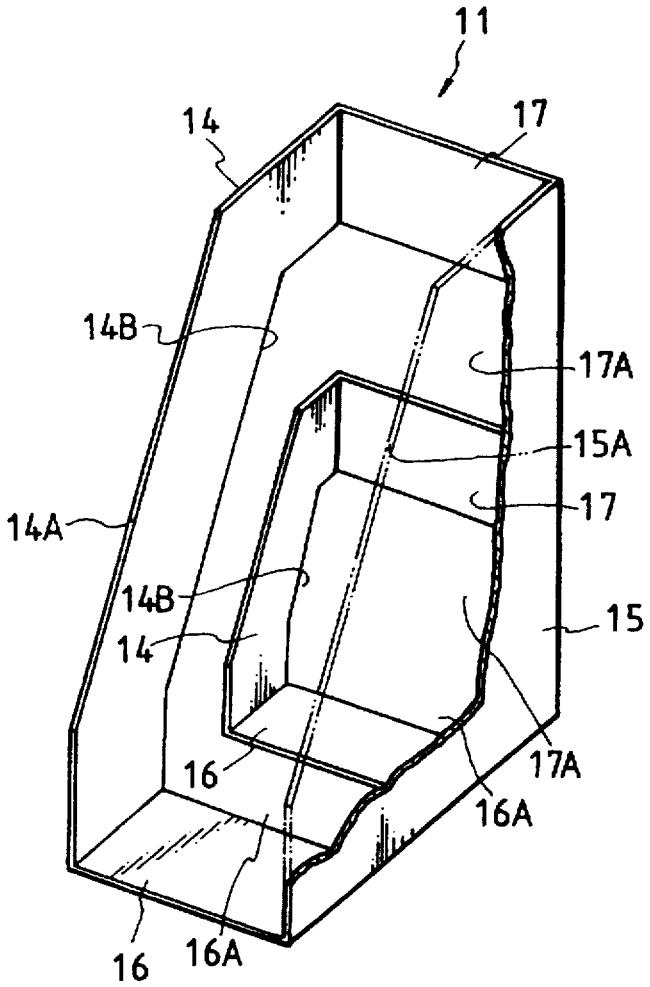
FIG. 2 is a perspective view of the first box forming component in the embodiment.
Figure 3:
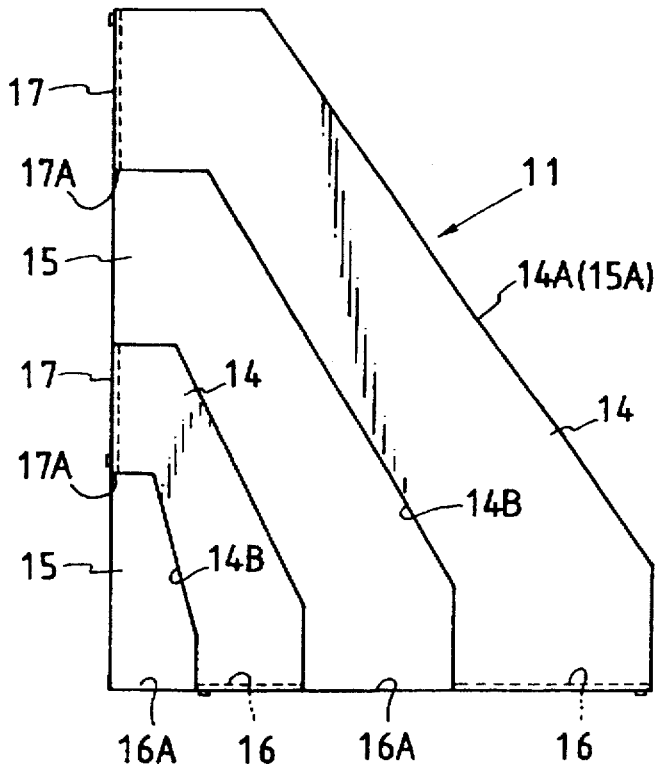
FIG. 3 is a left side elevational view of the first box forming component.
Figure 4:
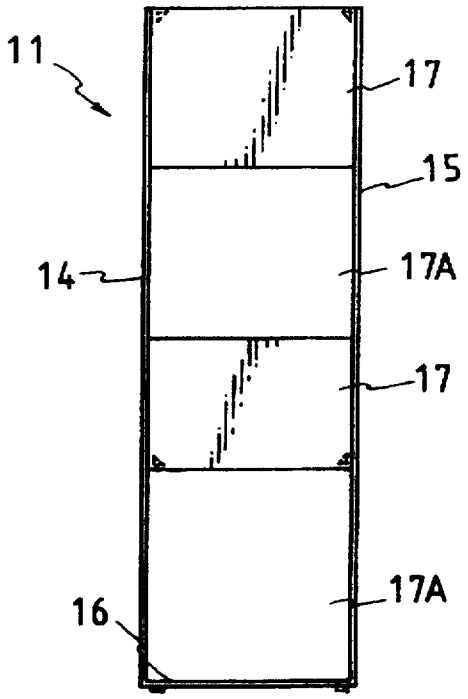
FIG. 4 is a front view of the first box forming component.

The first box forming component 11 is, as depicted in FIG. 2, defined by a pair of side walls 14 and 15 each of which is laterally facing each other in the drawing, bottom plates 16 laid across bottom edges of the side walls 14 and 15 to serve as a mount surface, and back walls 17 connected between the side walls 14 and 15. The side walls 14, 15 are formed to have inclined portions 14A, 15A slanting forward and as shown in FIG. 3, the left side wall 14 as shown in FIGS. 1 and 2 is provided with two cut-off portions 14B analogous to the inclined portion 14A.

Incidentally, in the embodiment, the bottom plates 16 are supposed to be the mount surface to stand the first box forming component 11 lengthwise, but it can be laid on its back walls 17 upon necessity. In this state, the bottom plates 16 will be naturally used as the back wall.

Now, referring to the bottom plates 16, it is separately disposed on one plane because of two cut-off portions 16A connecting with bottom portions of the cut-off portions 14B opened in the left side wall 14, as shown in FIG. 2. Similarly, the back walls 17 are also separately disposed on one vertical plane because of cut-off portions 17A consecutively connecting with back portions of the cut-off portions 14B opened in the side wall 14.

The above-mentioned first box forming component 11 is designed as a top-open type holder to receive therein documents as objects to be stored from a forward direction in FIGS. 1 and 2.

Figure 5:
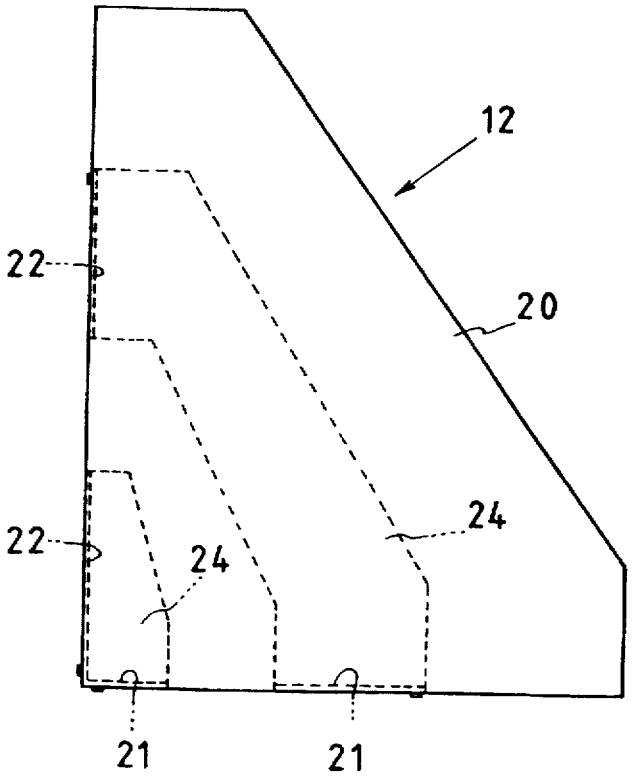
FIG. 5 is a left side elevational view of the second box forming component.
Figure 6:
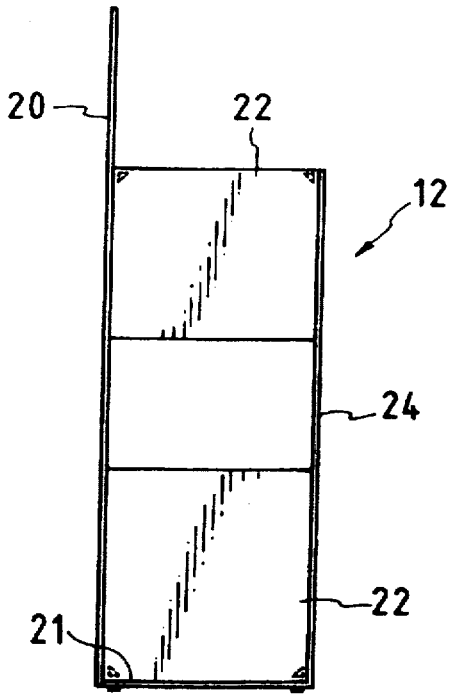
FIG. 6 is a front view of the second box forming component.

Turning to the second box forming component 12 is, as depicted in FIGS. 1, 5 and 6, defined by a side wall 20 having a symmetrical shape to the right side wall 15 of the first box forming component 11, bottom plates 21 connected with the bottom edge of the side wall 20 to serve as a mount surface, back walls 22 connected with the back edge of the side wall 20, and partition walls 24 spanning the bottom plates 21 and the back walls 22. Accordingly, the bottom plate 21, back wall 22 and the partition wall 24 should be understood to be dispersively arranged in two fields.

The positional arrangement of the bottom plates 21 and the back walls 22 in the second box forming component 12 is planed, as depicted by two-dotted line in FIG. 1, such that when it integrally combined with the first box forming component 11, they can be received preferably into the above-mentioned cut-off portions 16A, 17A without a mutual interference between the bottom plates 16 and the back walls 17 of the first box forming component 11, whereby the bottom plates 16 and 21 and the back walls 17 and 22 of the first and second box forming components 11 and 12 are respectively adapted to be disposed evenly. The partition walls 24 are also designed such that they correspond to the shape of the cut-off portions 14B formed in the side walls 14 of the first box forming component 11 to pass through the cut-off portion 14B and to be displaced between the side walls 14 and 15 of the first box forming component 11.

An operative sequence of the above-mentioned embodiment will be explained with reference to FIGS. 7 and 8.

Figure 7:
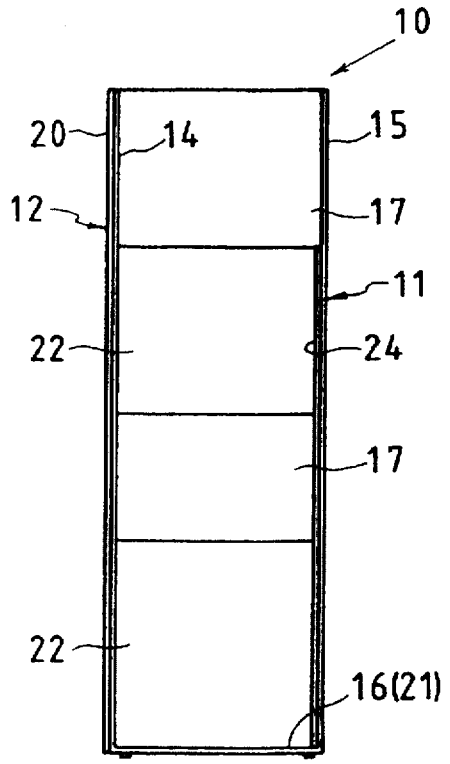
FIG. 7 is a front view showing a minimum width receiving state when the first box forming component and the second box forming component are coupled together.

As shown in FIG. 7, in an initial state of the box file 10 in accordance with the present embodiment, the bottom plate 21 and the back wall 22 of the second box forming component 12 are respectively received in the cut-off portions 16A and 17A of the first box forming component 11, whereat an inside surface of the right side wall 15 of the first box forming component 11 closes to outside surfaces of the partition walls 24 in the second box forming component 12. In this state, the left side walls 14 of the first box forming component 11 also gets close to the side wall 20 of the second box forming component 12. The clearance formed between these side walls can be expected as a permissible width to receive documents.

Figure 8:
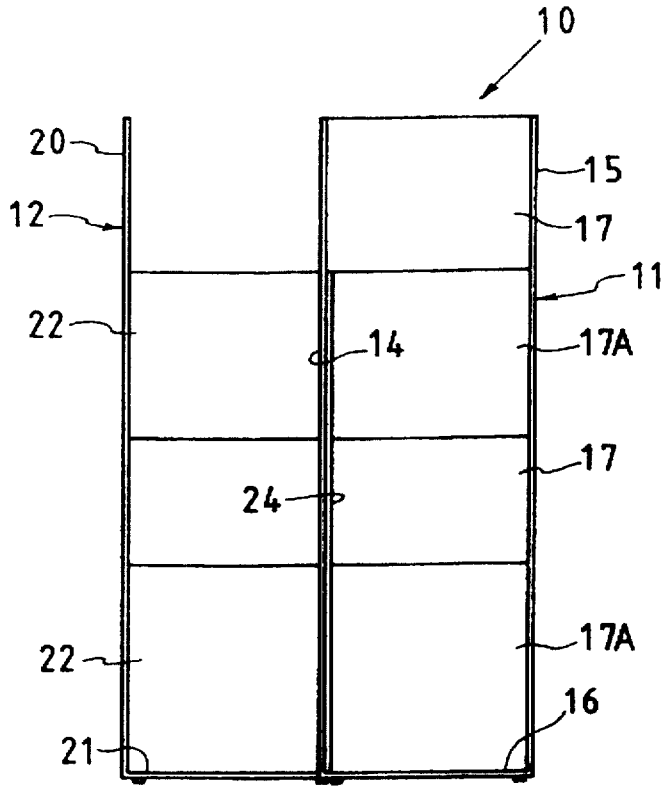
FIG. 8 is a front view showing a maximum width receiving state when the first box forming component and the second box forming component are coupled and shifted relatively.

If required to expand the width to receive much documents, the maximum permissible width comes true by shifting the side wall 20 of the second box forming component 12 from the left side walls 14 of the first box forming component 11 as shown in FIG. 8. Incidentally, the bottom plates 21 and the back walls 22 of the second box forming component 11 are guided by means of the cut-off portions 16A, 17A and it is therefore expected for the second box forming component 12 to be moved smoothly.

As a result, the width to receive documents become twice as long as the normal width when the side wall 20 of the second box forming component 12 is shifted, whereupon both box forming component 11 and 12 receive documents therein.

On the contrary, if a few document are put into the box file at the beginning of use, the side wall 20 of the second box forming component 12 and the side wall 14 of the first box forming component 11 are kept away from each other to some extent to form a clearance between the partition wall 24 and the right side wall 15 of the first box forming component 11 to thereby receive therein such a few documents. However, it will be naturally available to make stand the first box forming component 11 and the second box forming component 12 separately to be used individually.

Accordingly, the first and second box forming component 11 and 12 can be used in an individual or combined state, so that a few documents will be filed within a small space or width and much documents will be naturally filed expanding the width for receiving, whereby the documents is always filed within a minimum receiving space.

As the cut-off portions 16A, 17A formed in the first box forming component 11 are designed to couple with the bottom plates 21 and the back walls 22 of the second box forming component 12, when the first and second box forming components are coupled together, the bottom plates 16, 21 and the back walls 17, 22 are respectively aligned on the same plane without irregularities both on inner and outer surfaces entirely. The side wall 20 of the second box forming component 12 is only allowed to have a reciprocal movement with reference to the side wall 14 of the first box forming component 11 but regulated to move other right angled two axial directions, that is, in surface directions of the side wall 20, so that when the box file 10 receiving therein documents is lifted up, the coupling state of the first and second box forming components 11, 12 are not destroyed without any inconvenience to carry.

Reviewing a transportation problem for the box file 10, the first and second box forming components 11 and 12 are integrally wrapped and transported, so that it can be expected to reduce cost for wrapping and transporting. Furthermore, the first and second box forming components 11 and 12 can be separated to thereby use them individually.

Figure 9:
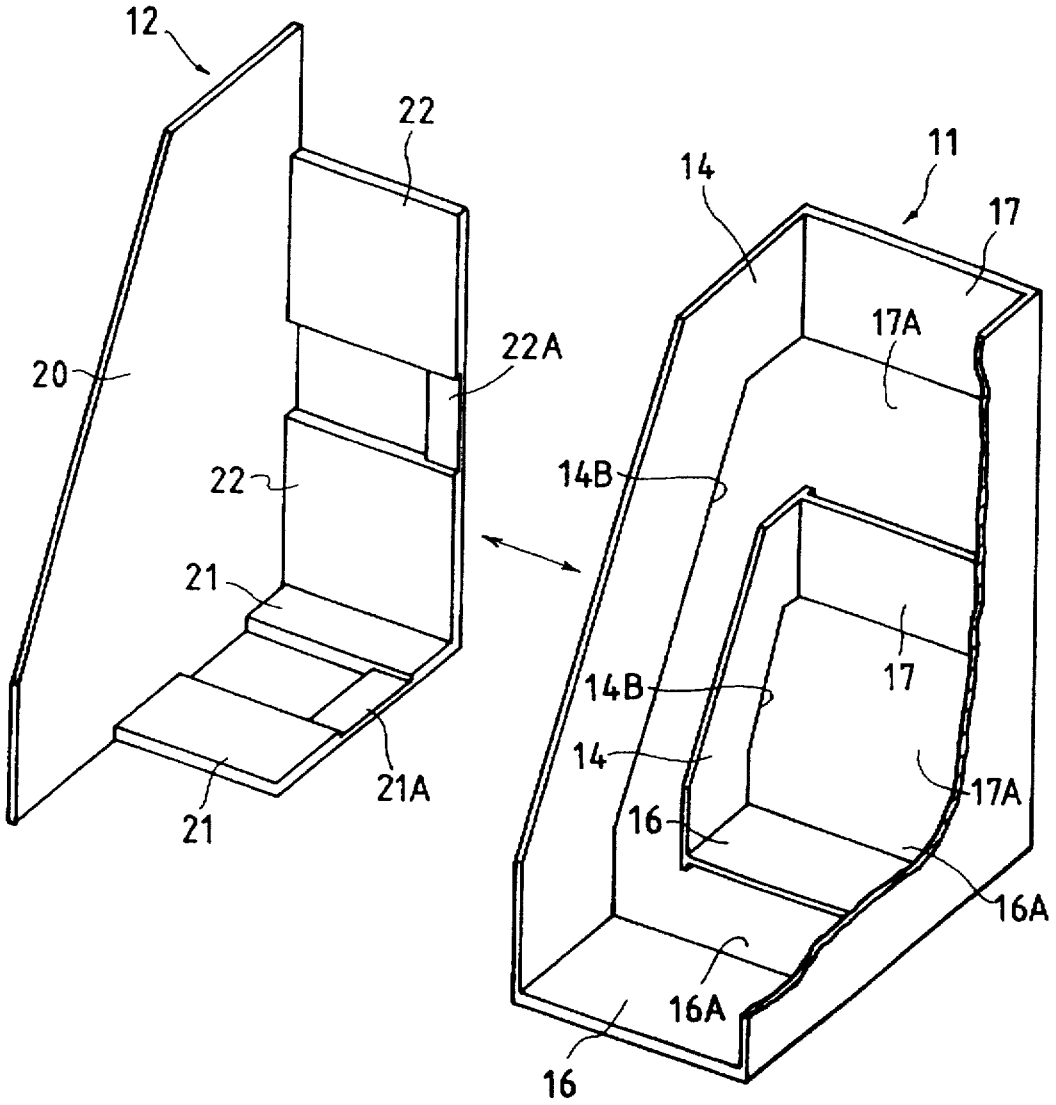
FIG. 9 is a perspective view of a second embodiment.

In the foregoing embodiment, the second box forming component 20 is designed to originally have the partition walls 24, but the partition walls 24 may be left out as shown in FIG. 9 illustrating the second embodiment. But, in this modification, it is recommended to have a joint member 21A between the separated bottom plates 21 and 21 of the second box forming component 12 as well as a joint member 22A between the separated back walls 22 and 22. This modification is preferable to simplify a mold for producing the second box forming components 12 and the molding cost can be cut down.

Figure 10:
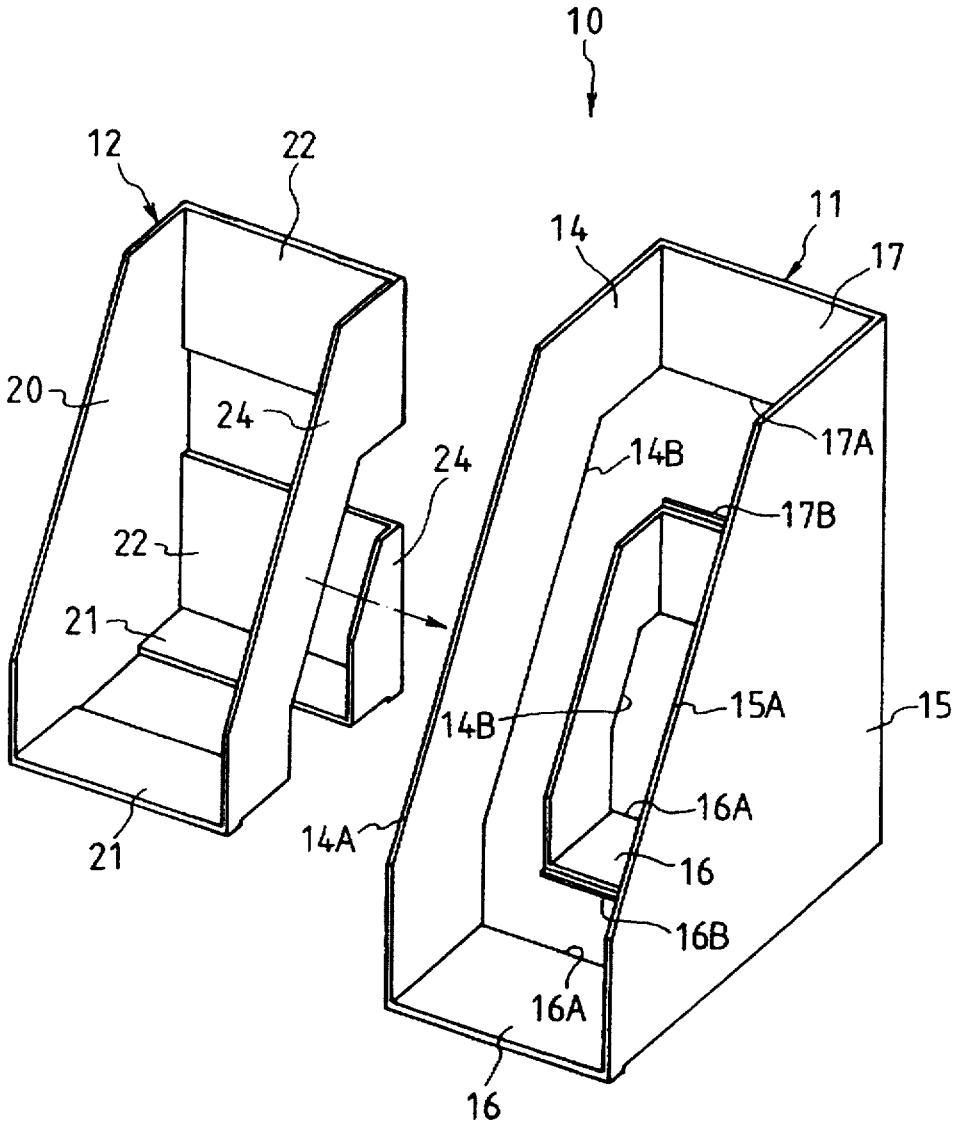
FIG. 10 is a perspective view of a third embodiment.

Furthermore, as shown in FIG. 10 which illustrates the third embodiment, the second box forming component 12 may be constructed such that the side wall 20 is formed into similar figures to the side wall 15 and is formed smaller than the side wall 15. Thin guide rims 16B and 17B may be provided at the edges of the bottom plate 16 and the back wall 17 of the first box forming component 11, so that the guide rims 16B and 17B can be utilized as a guide when the bottom plate 21 and the back wall 22 of the second box forming component are received in the first box forming component 11.

According to the third embodiment, the contour of the side wall 20 substantially corresponds to that in the large sized partition wall 24 to improve the outer appearance, so that a good balance in the design can be maintained when the second box forming component 12 is used separately. In addition, such an advantage can be attained that the possibility of crack to be occurred in the side wall 20 or the like can be reduced when the second box forming component 12 is dropped on a floor.

In the respective embodiment described above, at the relative edges sliding the bottom plates 16 and back walls 17 of the first box forming component 11 and the bottom plates 21 and back walls 22 of the second box forming component 12, there may be provided grooves and projections corresponding to the grooves to guide one on the other. This modification further assures a smooth reciprocal movement of the first and second box forming components 11 and 12.

The open state into the air is enough to be processed at least one top portion of the first and second box forming components 11, 12. The first box forming component 11 can be optionally provided with a front wall corresponding to the back wall 17.

In the foregoing embodiment, the bottom plates 16, 21 and the back walls 17, 22 are partially disposed into two parts, but they may be disposed at least of one portion or into more than three parts as far as standing straight.

The material for the box forming components 11, 12 may be paper or metal naturally as far as it involves certain strength. The external design of the respective box forming components 11, 12 should not be limited into those shown in the drawings but it may be designed into a mesh pattern.

The present invention is arranged and used as mentioned above, so that the width to receive the objects to be received is adapted to be changeable in conformity with an increase of the objects to thereby cooperate with various necessity and assure its stable sate, which could not be achieved by the conventional one.

INDUSTRIAL AVAILABILITY

The box file in accordance with the present invention is put on the desk and so on in an office when used to comfortably receive therein several documents.

I claim:

1. A box file characterized to have two or more box forming components in a relatively parallel state, each component being defined by at least one plate as a mount surface to make said box forming components stand straight and at least one side wall connecting with the plate, so that the respective plates of the box forming components are coupled evenly on one plane and a first box forming component and a second box forming component are provided such that an intervals between the side walls thereof are reciprocally closed or departed and the respective side walls are adapted not to move in surface directions mutually.

2. A box file, comprising: a first box forming component having a pair of side walls and at least one bottom plate and at least one back wall provided between the side walls in an opening state into the air at least at a top portion thereof; and a second box forming component having one side wall formed into a shape symmetrical to or a similar figure smaller than the side wall of the first box forming component and in a parallel state with reference to the side wall of said first box forming component and at least one bottom plate and at least one back wall provided between edges of the side walls, so that the bottom plates and back walls of the first and second box forming components are adapted to be coupled together and a first box forming component and a second box forming component are provided such that an intervals between the side walls thereof are reciprocally closed or departed and the respective side walls are adapted not to move in surface directions mutually.

3. A box file according to claim 2, wherein said first and second box forming components are provided such that the bottom plates and the back walls are respectively aligned on one plane.

4. A box file according to claim 2, wherein said first box forming component is provided with cut-off portions in the bottom plates and the back walls and wherein said second box forming component is designed such that the bottom plates and the back walls thereof are received in said cut-off portions.

5. A box file according to claim 4, wherein said cut-off portions are separately disposed.

6. A box file according to claim 2, wherein there are provided at least one partition wall having a smaller area than that of the side wall of the second box forming component between the bottom plate and the back wall of the second box forming component, and wherein one side wall of the first box forming component has cut-off portion corresponding to the partition wall, so that the partition wall passes through the cut-off portion and is disposed between the side walls of the first box forming component.

* * * * *